US005780758A

United States Patent [19]

McGill

[11] Patent Number: 5,780,758

[45] Date of Patent: Jul. 14, 1998

[54] MECHANICAL INNOVATIONS FOR RESONATOR GUITARS AND OTHER MUSICAL INSTRUMENTS

[76] Inventor: Paul D. McGill, 5543 Knob Rd., Nashville, Tenn. 37209

[21] Appl. No.: 855,017

[22] Filed: May 13, 1997

Related U.S. Application Data

[63] Continuation of Ser. No. 514,793, Aug. 14, 1995, abandoned, which is a continuation of Ser. No. 288,920, Aug. 11, 1994, abandoned.

[51] Int. Cl.[6] ..... G10D 3/02

[52] U.S. Cl. ..... 84/296

[58] Field of Search ..... 84/294, 295, 296, 84/299, 300, 301, 302

[56] References Cited

U.S. PATENT DOCUMENTS

| | | | |
|---|---|---|---|
| 880,137 | 4/1908 | Lang | 84/298 |
| 3,931,753 | 1/1976 | Dopera | 84/294 |

*Primary Examiner*—Cassandra C. Spyrou
*Attorney, Agent, or Firm*—Conley, Rose & Tyon; B. Noel Kivlin

[57] ABSTRACT

A guitar or similar musical instrument with a resonator cone insert has been improved in several respects. My improvements include the development of a structural support ring made of graphite with circumferentially aligned strengthening fibers integrated within the circumference of the support structure, a sealing ring for sealing the cone cover in the structural support ring, the sealing ring being tubular in cross section and compressed to a figure-8 cross section to create additional pressure for holding the cover plate in place securely and eliminating "rattling" of the cover plate to distract from the sound of the instrument. Another feature of the design of the present invention is the provision of a interlocking connection between the structural support ring and the resonator support ring which allows one to change the size, shape and configuration of the resonator support ring to create different sounds. Further, my invention includes a section of the butt of the instrument bevelled at an angle to the plane of the face of the instrument to facilitate variations in string tension which will allow variations in the tonal quality and output of the instrument. An alternative structure provides for a cantilevered tail piece, the angle of which can be varied, in order to vary the pressure on the bridge and saddle of the instrument. Finally, my design includes variations in the ports contained within the instrument in order to improve the quality of output. I also provide a new and improved tuning machine roller which can be of variable diameter to allow tuning of the instrument in a more defined manner even when strings of different materials or diameters are used.

11 Claims, 8 Drawing Sheets

MECHANICAL INNOVATIONS FOR RESONATOR GUITARS AND OTHER MUSICAL INSTRUMENTS

This application is a continuation of application Ser. No. 08/514,793, filed Aug. 14, 1995, now abandoned, which is a continuation of application Ser. No. 08/288,920, filed Aug. 11, 1994, now abandoned.

BACKGROUND OF THE INVENTION

The present invention relates generally to the design and manufacture of guitars and more particularly to modifying and improving the durability, scale lengths, character of sound, and ease of use of resonator guitars and other musical instruments.

It will be appreciated by those skilled in the art that resonator guitars have been on the market for many years and that such instruments are a valuable contribution to improving the range, unique sounds and force of stringed instruments, particularly instruments that are or cannot be electrically amplified.

Resonators have been used to give guitars a penetrating, dynamic sound with a large presence. Del Vecchio, National, Dobro and Regal are all product names for resonator guitars.

The National, Dobro and Regal resonator designs differ from the Del Vecchio. They are used largely, but not exclusively, by the slide bar guitarist. Traditionally, their sounds could be heard in the music of the Mississippi Delta, country blues and blues of the mid-20th century.

American in origin, these instruments were made to produce as large a volume as possible. They gained popularity for their ability to stand out in ensembles in which the guitar's role historically had been percussive. To achieve volume, the design created instruments that could withstand the higher tensions caused by using heavier gauged strings.

Del Vecchios, which come from Brazil, have a sound which is suitable for guitarists who play using a standard technique. They have been used in Latin American jazz, Brazilian folk, classical and contemporary styles of music. The Del Vecchio has the ability to generate a sustained sound by exciting the cone using a technique called vibrato. Unlike other resonators, the lower tension Del Vecchio has a warmer and more colorful sound than its more traditional, raucous-sounding relatives.

Made of aluminum, all resonator cones are spun or stamped into a shape resembling a pie pan. One can be mounted in either a convex or concave position. The American-made models incorporate cones, truncated or otherwise, which are heavier than the truncated Brazilian Del Vecchio cones.

Pressure on the resonator cones is minimized for greater volume. On Dobros, which incorporate a tension adjuster for cone pressure, a device known as a spider supports the strings and transmits vibration. Pressure on the cone can also be reduced by simply using a very low string angle over the saddle.

The resonator cone is supported by cylindrical, resonant ring known as the resonator support ring (RSR). The RSR is inserted into the instrument to provide a shelf around its circumference. The cone rests on this shelf. The resulting cavity is covered by either a wooden or metal plate. This plate protects the fragile cone. In the case of the metal designs, the plate which offers significant structural support for the body opening. The metal plate is attached by screws. The wooden cover plate of the Del Vecchio has a recess at the top of its RSR. The coverplate rests in this recess, held in place by a wire expansion ring.

On Del Vecchios the downward pressure of the strings, mediated by a bridge and saddle, squeeze the cone onto the shelf of the RSR. The bridge and saddle protrude through an opening in the center of the cover plate, exposing the bridge which sits on the cone. To insure that the cone is not collapsed by a blow to the bridge, the bridge has to be protected by a hand rest or covering device. The covering device is attached to the cover plate to absorb any pressure directed at the bridge. On metal Debro and National designs, the hand rest is stamped into the shape of the cover plate with openings for the strings to pass through.

Cover plates have holes or openings of other shapes which allow air and sound to leave the resonator cavity. In addition, openings are cut in the top face, outside the circumference of the resonator cavity, to allow sound to escape from the underside of the cone. Openings in the cover plate allow sound to also escape from the top side of the cone, resulting in an out-of-phase sound projection.

The strings are affixed to a trapeze (or other type) tail piece mounted to the end block at the lower center of the guitar. The sides and back of the instrument are like other acoustic guitar designs, with linings between the different surfaces and braces supporting the back. The neck protrudes from the upper center of the body and has a playing surface, or fingerboard, in which frets are mounted to scale. The end of the neck supports a peg head or headstock to which pegs or winding gears are attached for changing tension on the strings.

Each of these prior art works, have demonstrated strengths and weaknesses in design, which create a unique sound for each design. However, a sound can be so defined that its usefulness is limited. This should be avoided. Del Vecchios have a weakness in cone tension due to their lack of string tension and shorter scale length. Thus, when using light tension strings, it becomes difficult to keep the resonator cone in form contact with the resonant cylinder shelf while the cone transmits the vibrations generated by the strings.

Most resonator guitars are heavy, making handling and support during use cumbersome. Some have operational nuisances, such as ergonomically incorrect hand rests or top openings, rattling due to the lack of proper cone tension, and metal screws or other design problems which give them a reputation for being "funky".

Some of the problems encountered in playing, servicing and making resonator guitars are:

a) Due to the limits of current Del Vecchio guitar design, this manufacturer has to change the body shape for each scale length.

b) On a Del Vecchio, a greater distance between the saddle and the reinforced end block where the tail piece is mounted reduces the string angle over the saddle.

c) The Del Vecchio design does not allow for extended fret placement on the neck. This limits the octave placement, or 12th fret, to the edge of the upper bout where the neck is joined to the body. To increase the number of frets between the headstock and the body, the body length would need to be shorter. A shorter body length would be unworkable since it would move the placement of the bridge and RSR higher in the body outline.

d) The resonator cavity of the Del Vecchio is a major structural weakness. The wooden cover plate of the Del Vecchio design will buckle over time as the body collapses into the cavity under lateral string tension. To prevent this, all resonator designs incorporate a reinforcement bar between the end blocks. While the screwed-on metal cover plate, combined with the internal bar, offer adequate support, they add a great deal of weight when used together or separately.

e) The wire expansion ring design of the Del Vecchio, while adequately accomplishing the task of holding down the cover plate, is difficult to remove and install. Quick replacement is difficult in any work setting.

f) None of the prior art designs have adequate devices to control or adjust the string angle over the saddle when very low tensions strings are desired. The Dobro spider design merely adjusts cone tension beneath the spider using an adjustment screw, and the Dopera U.S. Pat. No. 3,931,753 adjusts through only a limited range.

g) Historically, body port holes have been made in a symmetrical design. This causes equal wavelengths of sound to project from the body simultaneously. This symmetry can create a canceling and/or dead note effect on certain notes.

h) The symmetrically placed port holes on the Del Vecchio's cover plate interfere with the positioning of the player's hand, resulting in awkward hand placement.

i) The string angle of prior art instruments over the saddle makes using all, or certain low, tension strings impossible. Different string materials require different string angles to hold the strings in their saddle slots. In some cases, more downward pressure is required to hold the cone in tightly for clean contact with its support shelf.

k) Using different string materials simultaneously on a guitar creates an additional problem of tuning. Besides creating wildly varying intonation on different strings, a difference in material can greatly effect the feel of tuning strings from peg to peg on the head stock. In some cases, this effect can double the turning ratio of the peg as it relates to an increase or decrease in frequency change.

What is needed, then, is an instrument design that overcomes these problems and difficulties of the prior art. This device is presently lacking in the prior art.

It is therefore an object of the present invention to modify the Del Vecchio design for the easier use of different bridge placements not currently possible due to design geometry.

It is a further object of the present invention to incorporate a self-supporting device inside the resonator cavity which prevents structural failure.

It is yet a further object of the present invention to make cone access easier for quick changes.

It is another object of the present invention to make wider variations in adjusting cone pressure possible using a simple and inexpensive design.

Another object of the present invention is to reduce unnecessary weight.

Yet another object of the present invention is to make a more versatile recording instrument, while minimizing possible dead notes.

Another object of the present invention is to make the instrument more ergonomically versatile for the player's picking hand.

A still further object of the present invention is to make tuning more predictable.

SUMMARY OF THE INVENTION

A guitar or similar musical instrument with a resonator cone insert has been improved in several respects. My improvements include the development of a structural support ring made of graphite or wood with circumferentially aligned strengthening fibers integrated within the circumference of the support structure, a sealing ring for sealing the cone cover in the structural support ring, the sealing ring being tubular in cross section and compressed to a figures-8 cross section to create additional pressure for holding the cover plate in place securely and eliminating "rattling" of the cover plate to distract from the sound of the instrument. Another feature of the design of the present invention is the provision of a interlocking connection between the structural support ring and the resonator support ring which allows one to change the size, shape and configuration of the resonator support ring to create different sounds. Further, my invention includes a section of the butt of the instrument bevelled at an angle to the plane of the face of the instrument to facilitate variations in string tension which will broader variations in the tonal quality and output of the instrument. An alternative structure provides for a cantilevered tail piece, the angle of which can be varied, in order to vary the pressure on the bridge and saddle of the instrument. Finally, my design includes variations in the ports contained within the instrument in order to improve the quality of output. I also provide a new and improved tuning machine roller which can be of variable diameter to allow tuning of the instrument in a more defined manner even when strings of different materials or diameters are used.

DESCRIPTION OF THE PREFERRED EMBODIMENT

Figure 1:
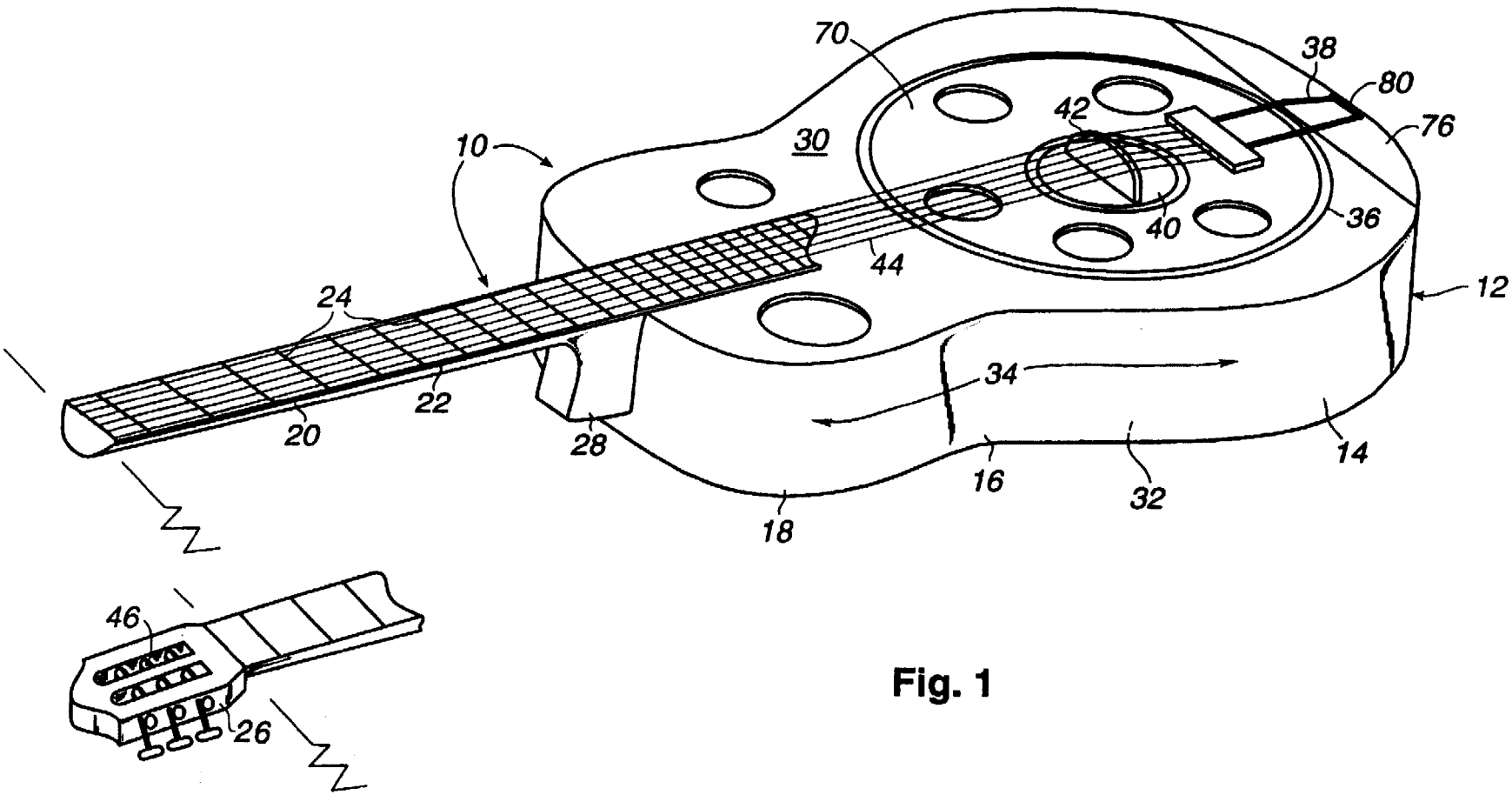
FIG. 1 is a perspective view of a guitar containing the features of my invention.

Referring now to FIG. 1, the instrument 10 of my invention is shown in perspective view. The instrument 10 which has been selected for illustrating the improvements of my invention is a guitar and includes a body 12 having a lower bout 14, a waist 16 and an upper bout 18. The instrument 10 has a neck 20 and joined on the top of the neck is a fret board 22. Mounted within the fret board 22 are frets 24 against which the strings of the guitar are pressed for generating musical scale during the course of play of the instrument 10.

Figure 2:
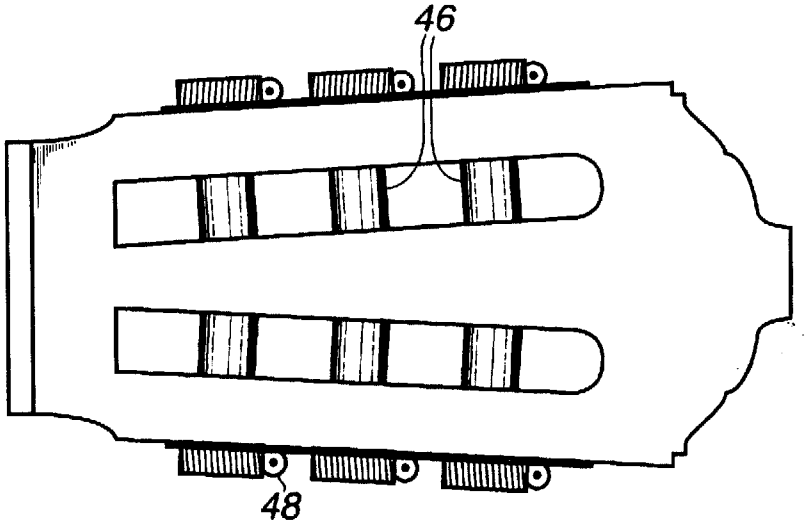
FIG. 2 shows a plain view of the head stock of my invention.

At the top of the instrument 10 and attached to the upper most end of the neck 20 is head stock 26 (see FIG. 2). The head stock 26 is constructed in the ordinary fashion for a guitar and includes tuning rollers 46 about which the strings of the instrument are wound. The tuning buttons 48 can be turned to tighten or loosen the tension on the strings and thereby tune the instrument or adjust the tuning of the instrument.

Figure 4:
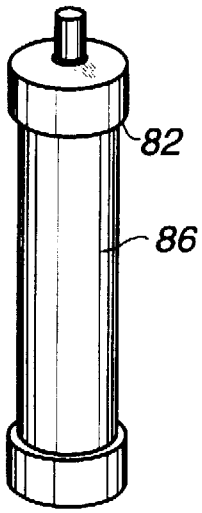
FIG. 4 shows the improved tuning roller of my invention in perspective.
Figure 3:
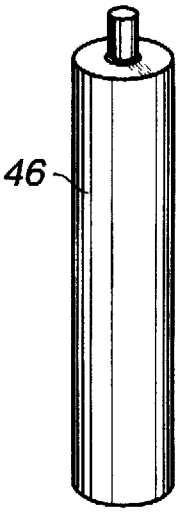
Fig. 3 (prior art)
FIG. 3 shows a standard tuning roller of the prior art.

As indicated in sub-paragraph k) above, one of the problems with the existing instruments is the variations in tuning intonation of different strings. A difference in the material from which the string is constructed can greatly affect the feel of tuning strings from peg to peg on the headstock. Referring to FIGS. 3 and 4, as indicated in the description of the drawings, FIG. 3 shows a standard tuning roller of the prior art. FIG. 4 shows the improved tuning roller of my invention in perspective. The improved tuning roller of my invention as illustrated in FIG. 4 has a reduced diameter center portion 86 as compared to the larger diameter end portions 82, 84, both of which would be the same diameter as the entire length of the tuning roller 46 of the prior art.

Figure 5:
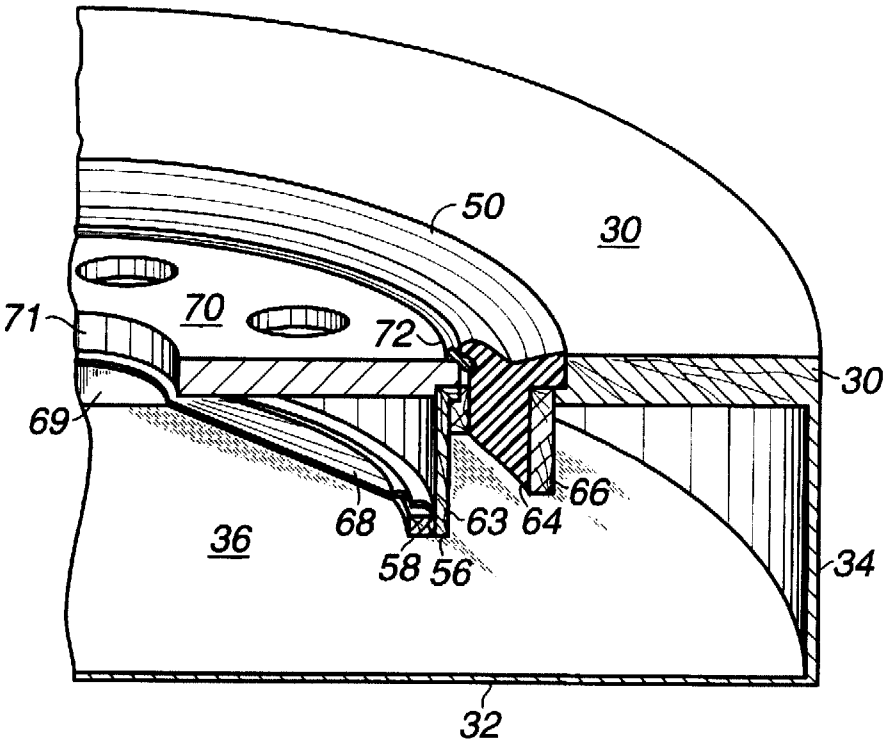
FIG. 5 is a cut away of the bottom of my guitar in perspective showing the details of the integrated structural support ring and the resonant cylinder.

Referring back to FIG. 1, the lower portion of the neck is adjoined at the top 30 of the instrument by heel 28 in the ordinary fashion. The instrument further includes back 32 and side 34 as can be seen from both FIG. 1 and FIG. 5. Referring now to FIGS. 1 and 5, there is shown a resonator cavity 36. The resonator cavity 36 is created by cutting or forming a hole in the top 30 of the instrument to allow the chamber of the instrument formed by the top 30, back 32 and side 34 to communicate with the environment. Fitted within the resonator cavity is a resonator cone and a cover plate as will be described in more detail hereinafter.

The general construction of the instrument includes a tail piece 38 mounted to the bottom of the instrument and extending over the top 30 of the instrument 10. The tail piece 38 has a free end 39 to which strings 44 are attached. The strings 44 pass over the saddle 42 which rests on bridge 40 and the strings then pass along the fret board 22 facing the neck 20 of the instrument and are connected to the tuning rollers 46 in the normal manner.

As can be seen from FIGS. 1, 5, 6 and 7, fitted within the resonator cavity 36 of the instrument 10 is a structural support ring 50 on which is mounted a resonator support ring 56 which in turn supports the resonator cone 68 within the resonator cavity 36. Cover plate 70 fits over the resonator cone and rests on the top of the resonator support ring 56 at its point of juncture with the structural support ring 50.

The resonator cone 68 is held in place by the pressure of the strings 44 transmitted through the saddle 42 to the bridge 40 which rests on the truncated section 69 of the resonator cone 68.

Figure 6:
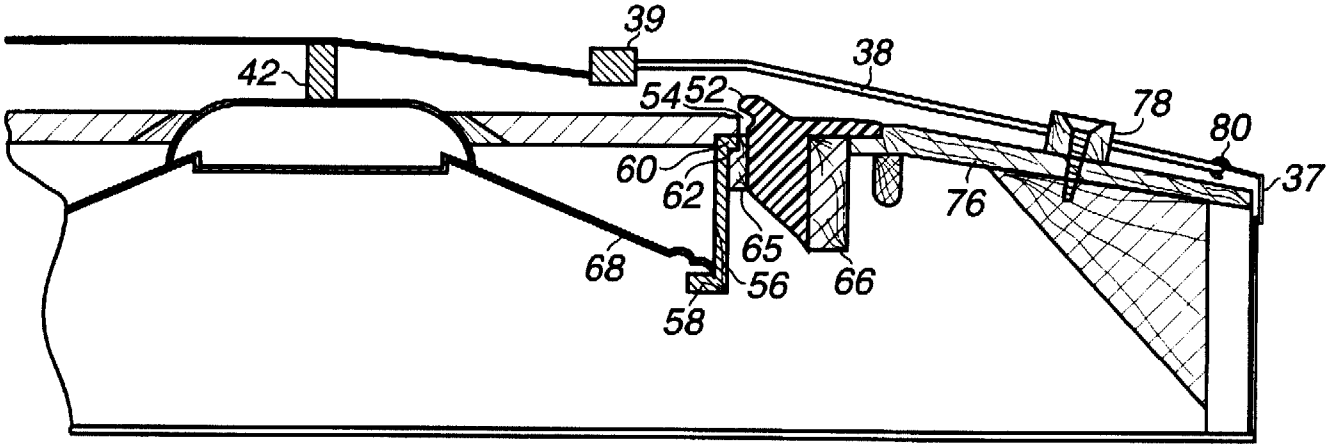
FIG. 6 is a cross sectional view of the bottom of a guitar illustrating the beveled panel construction of my invention and removable resonant cylinder.

Referring now to FIGS. 5 and 6, the structural support ring 50 has, in cross section, a sealing lip 52 and a sealing cavity 54. When the cover plate 70 is placed on the shoulder formed at the juncture of the resonator support ring 56 and structural support ring 50, it is sealed in place by sealing tube 72. Sealing tube 72 is a loop of elastic type material, preferably rubber or synthetic type material, and is cylindrical in cross section when at rest. When assembling the instrument, the sealing tube 72 is pressed around the circumference of the structural support ring 50 beneath the sealing lip 52 into the sealing cavity 54 and into pressured engagement with the outer perimeter of the cover plate 70. The pressured engagement of the sealing tube 72 between the sealing lip 52 and the outer perimeter of the cover plate 70 causes the sealing tube 72 to crimp and to form into something of a "figure-8" cross sectional shape creating constant pressure between the sealing lip 52 and the outer circumference of the cover plate 70 to hold it firmly.

The cover plate 70 does not touch the resonator cone 68 but rather, is spaced from the resonator cone 68 and the cover plate 70 has an opening 71 in the center thereof to accommodate the bridge 40 as it protrudes upwardly from the truncated section 69 of the resonator cone 68.

Through this manner of construction, the strings 44 are allowed to hold the resonator cone 68 into place by virtue of the pressure passing through the saddle 42, bridge 40 and onto the truncated section 69 of the cone 68. More importantly, the vibrational action of the strings when the instrument is being played is transmitted to the cone in order to amplify the musical sounds produced during the play of the instrument.

The structural ring 50 is glued into the cavity 36 in the top of the guitar. This ring counters the lateral forces created by the string tension pulling the guitar from its ends. To insure structural integrity, this upper ring is designed with circumferential fibers. The ring can be made of inner 65 and outer 66 wood reinforcement bands, a combination with wood and graphite band(s), a composite graphite structure, or any material that offers rigid, three-dimensional structural integrity.

Prior art instruments will not support the cavity 36 without a metal cover plate and/or a structural support bar inside the guitar. The structure of applicant's design thus adds to its lateral strength; keeping the guitar surface on a two-dimensional plane and supporting the guitar body without any other reinforcement devices.

The structural support ring 50 may be an integrally manufactured element with the resonator support ring 56, or those parts may be created separately. As indicated, my internal support bars and metal supporting cover plates. The structural support ring 50 will maintain the shape and structural integrity of the cavity 36 of the instrument 10, independent of the cover plate or the internal support bars which traditionally have supported the cavity 36 and kept it from collapsing upon itself . Further, the structural support ring 50 has an undercut 64 which shortens contact between the SSR 50 and RSR 56, allowing for a longer cylinder wall in the RSR 56, uninhibited by the mass of the SSR 50, contributing to the quality of the sound of the instrument by allowing a more vibrant resonant cylinder.

If the structural support ring 50 is completely self supporting, without additional strengthening of a glued in resonator support ring 56, the resonator support ring 56 may be removably seated on the step 62 formed about the inside perimeter of the structural support ring 50 via the flange 60 protruding radially outwardly from the resonator support ring 56. In those constructions of lesser strength, the resonator support ring 56 must be glued to the structural support ring 50 to provide additional strength to the construction.

Referring now to FIGS. 5 and 6, the resonator cone 68 sits on shelf 58 of the resonator support ring 56. The shelf 58 projects radially inwardly into the resonator cavity 36 so that the cylindrical mouth resonator cone 68 may rest on the ledge of the shelf 58. The resonator cone 68 is a very thin spun metal, generally aluminum, or alloy material that serves as a "pick up" for the sound generated by the strings of the guitar and both amplifies that sound as well as adding tonal qualities to it.

To vary the tonal qualities of the instrument further, it is desirable to change the string diameters and materials to adjust the resonant qualities transmitted through the saddle 52, bridge 40, and resonator cone 68. Specifically, because of the string angle created by the length of the distance from the saddle 42 to the bottom of the instrument, any variations in the density of the strings 44 would have limited effect in terms of downward pressure of the saddle 42. One of the features of my invention is the development of a tailpiece 38 and body 10 design which allow for the increase in the tension on the strings 44 as they break downward over the saddle 42 and thus increase potential pressure on the resonator cone 68 as transmitted by the saddle 42 and bridge 40. This device allows for sufficient string angle over the saddle 42 without the need for a mechanical tailpiece to depress the strings.

Figure 7:
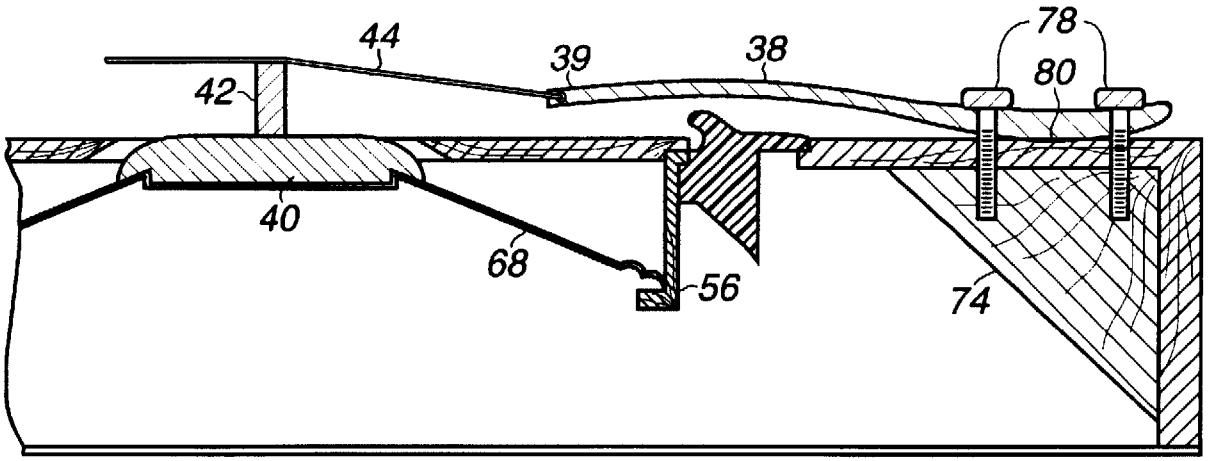
FIG. 7 is a cross sectional view of the bottom portion of my guitar showing the adjustable tail piece to adjust the pressure on the strings of the guitar.

The adjustable tail piece of my invention as illustrated in FIGS. 6 and 7. There are two separate embodiments of this particular feature of the invention. Referring first to FIG. 6, I have provided a beveled panel 76 at the bottom of the instrument. The beveled panel can be seen in both FIG. 1 and FIG. 6. The beveled panel causes the bottom portion of the top 30 of the instrument to be at an angle to the portion of the top 30 in which the resonator cavity 36 is created, thus creating a lower plane for the tail piece to connect to the body of the instrument.

The lower plane allows the tail piece 38 to be connected on a plane below the normal plane of the top 30 of the instrument. By being below the plane of the top 30 of the instrument, more angular movement can be created and thereby more pressure can be developed on the strings 44 when the tail piece is pivoted about its cantilevered connection. Specifically, the tail piece 38 is connected at the bottom of the instrument and extends across the top of the instrument to the free end 39 of the tail piece where the strings 44 are connected. Intermediate the free end 39 of the tail piece and the point of its connection to the bottom of the instrument is hinge 80 which allows the tail piece to rotate slightly about the hinge 80 as pressure is applied to the tail piece via the tail piece adjustor 78. The tail piece adjustor 78 in this particular case is a block and screw structure which allows the tail piece to be lowered by tightening the screw and raised by loosening the screw. Thus, the movement of the free end 39 of the tail piece is magnified by modest adjustments in the location of the screw of the tail piece adjustor 78. Referring now to FIG. 7, an alternative structure for the adjustment of the tail piece is shown. In this particular case, the hinge 80 is a bow on the bottom side of the tail piece 38 and the tail piece adjustor 78 are two separate screws passing into the stabilizing block 74 of the instrument. In this particular case, as the two screws of the tail piece adjustor 78 are loosened on the one side and tightened on the other, the tail piece 38 is caused to rotate about the hinge point 80. Rotation of the tail piece 38 about the hinge point 80 causes the free end 39 to move up and down in a magnified fashion and thereby create greater pressure or lesser pressure on the strings 44 which will then be transferred to the resonator cone 68 to change the tonal quality of the instrument.

Figure 8:
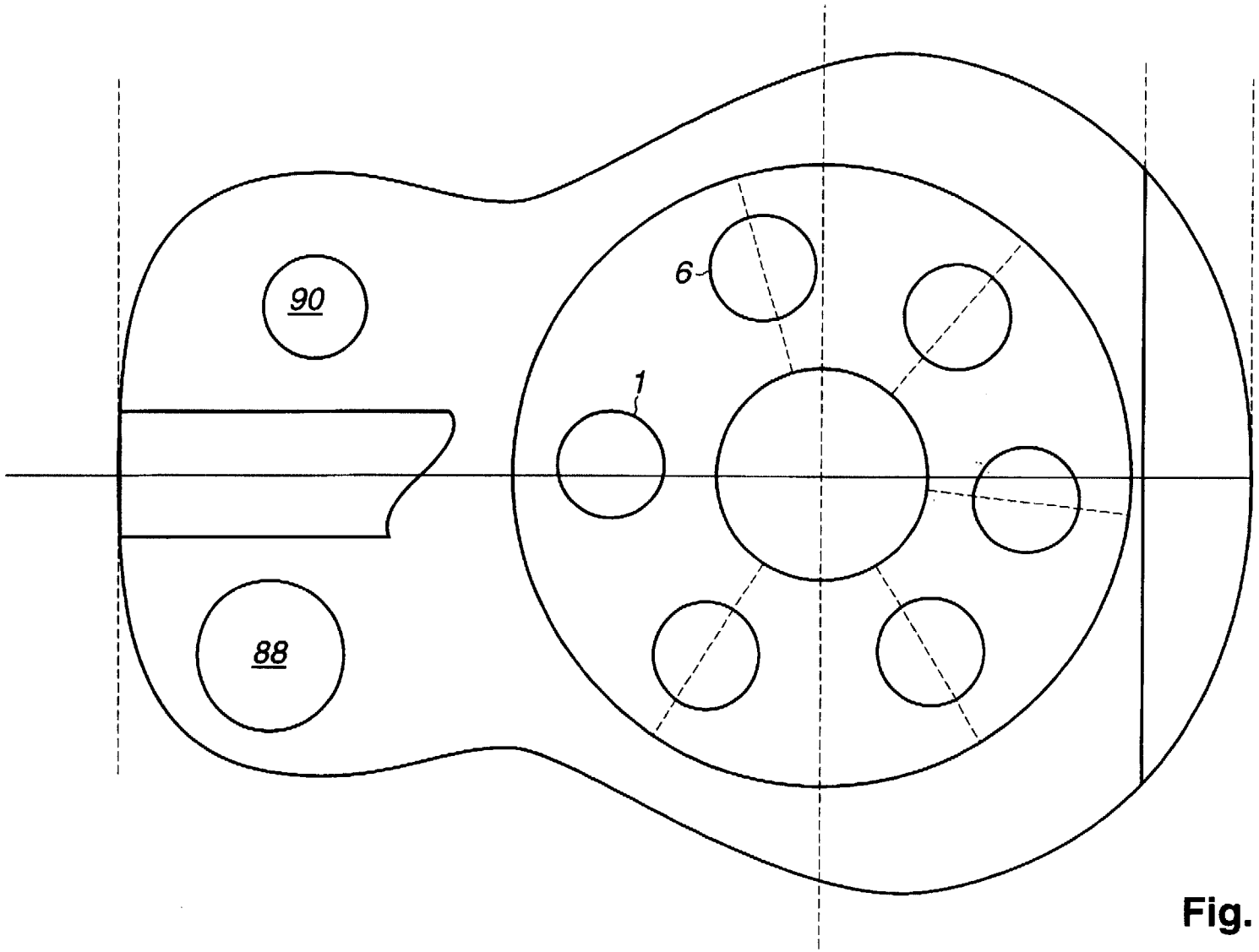
FIG. 8 is a top view of my invention.
Figure 9:
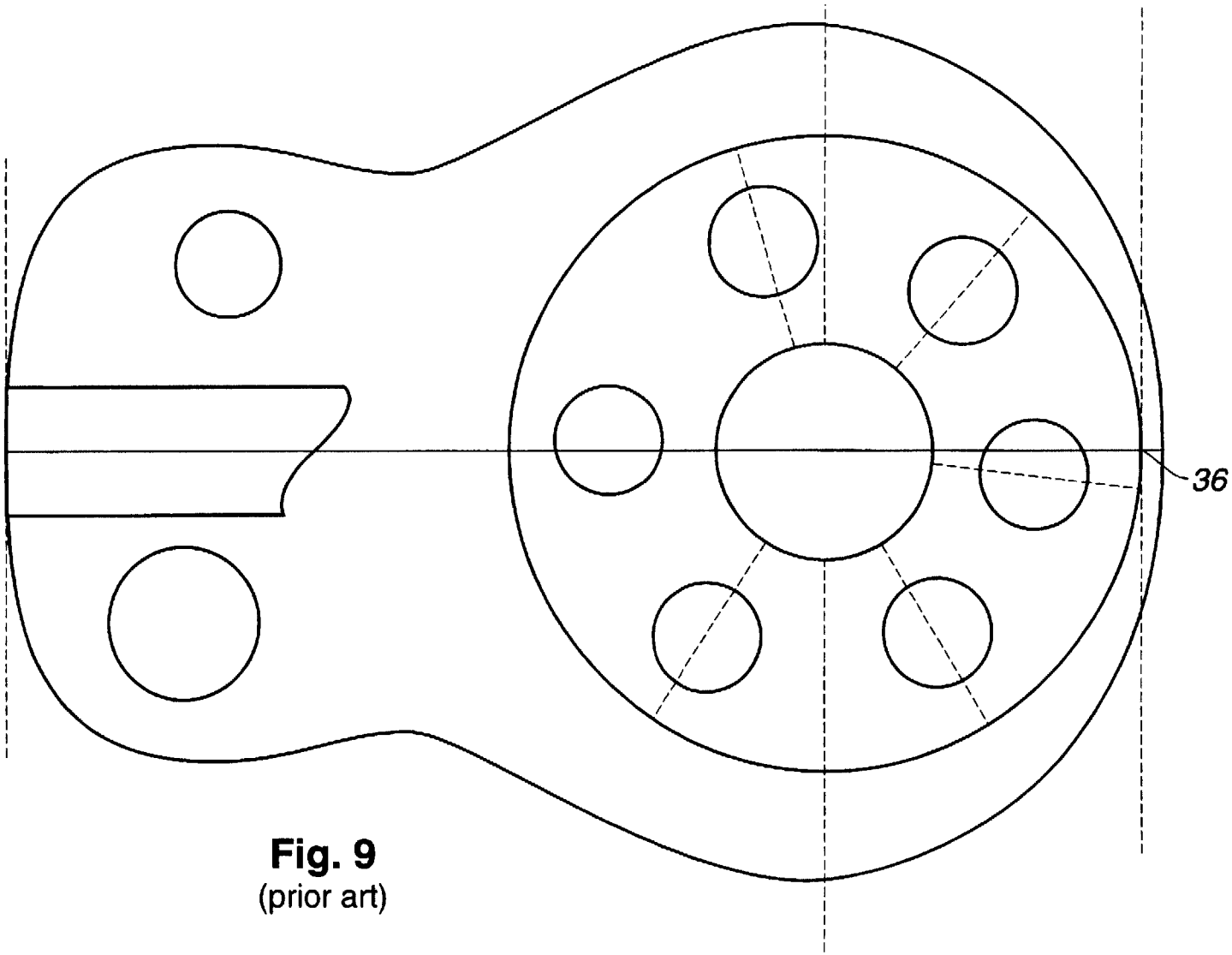
Fig. 9 (prior art)
FIG. 9 shows a top view of the prior art instruments of this type.

Referring now to FIGS. 8 and 9, particular advantages and features of my invention can be more readily illustrated. FIG. 9 illustrates a prior art Del Vecchio type instrument. Historically, in order to change the scale of a Del Vecchio instrument, it was necessary to change the size of the entire instrument. This was a limiting factor in the manufacturing of instruments of this type. The reason that it was necessary to change the size of the instrument entirely in order to change its scale was because the resonator cavity 36 had to be constructed in as near proximity to the bottom of the instrument as possible in order to facilitate a greater angle of the strings as they break over the saddle. Greater string angle was necessary in order to apply sufficient pressure on the saddle, and in turn on the cone, to keep the cone in place within the instrument, a problem that was particularly acute when using low tension strings.

Constructing the instrument with the cavity 36 at the bottom of the instrument limited the scale to a length corresponding to the overall length of the body 12. If a different scale was required, the instrument would have to have a body 12 of either a larger of smaller size. Such construction processes complicate the construction of instruments of different scales and limit the ability to economically manufacture a variety of designs.

Applicant's invention involves the development of a system by which instruments of different scales can be manufactured using the same body, requiring only a change in the location of the resonator cavity 36 on the top 30 of the instrument, with or without a cantilevered tailpiece. Referring to FIG. 8, for example, it can be seen that the resonator cavity 36 is moved toward the neck of the instrument as is compared to the location of the resonator cavity shown in the prior art structure illustrated in FIG. 9. Heretofore, moving the resonator cavity toward the neck of the instrument was not, as a practical matter, possible, because adequate pressure could not then be generated on the bridge of the instrument in order to create pressure on the resonator cone to hold the instrument together.

By use of Applicant's beveled panel 76 and the tail piece adjustment mechanism, it is possible to manufacture instruments having different scales all using the same body pattern and size by only changing the location of the resonator cavity 36 within the top 30 of the body and eliminating the requirement that a different sized body be used. This process is a tremendous enhancement in the manufacturing of such instruments and allows them to be produced with substantially increased economies of scale, quicker, and at a cost that will make them more available to mass production.

The final feature of Applicant's invention that is an improvement over the prior art is the location of the various ports within both the cover plate 70 and the top 30 of the instrument itself. As can be seen from FIG. 8, there are six (6) openings in the cover plate. A shift in the traditional layout of sound holes moves the sound hole on the treble side of the strings away from the player's hand, leaving a solid platform in which to rest the hand. The cover plate has the function of protecting the cone while at the same time allowing sound to pass through to the outside. The invention allows for both functions while incorporating an additional purpose of creating a workable station for the player's hand.

In addition to the practical aspects of the redesigned cover plate hole pattern, two holes of different sizes are placed on each side of the fret board on the upper bout of the guitar. These holes port sound projected from the bottom of the cone. The function of these holes is to focus different frequencies of sound waves which are created in the body out of different areas of the top. This separation of frequencies limits the chance that two frequencies might cancel each other out, increases the efficiency of sound projection and allows for more even projection from note to note. In addition, separation of frequencies as they are projected from the top, in conjunction with a microphone, allows the player to control equalization by placing the microphone in the desired location to receive the frequencies desired.

The two holes on each side of the fret board are labeled 88 and 90. Hole 88 is substantially larger than hole 90 in order to vary the frequency of the sound emanating from the instrument to avoid cancellation of sounds of equal wave lengths that occurs when ports of equal size are employed.

The arrangement of the holes in the cover plate 70 are designed at approximately 56° on center starting with a hole in alignment between the saddle and the neck and progressing toward the top of the instrument to the back and then to the bottom thus leaving a space between holes 6 and 1 of greater magnitude and thereby facilitating the player's hand as heretofore described.

Thus, although there have been described particular embodiments of the present invention of a new and useful Mechanical Innovations For Resonator Guitars and Other Musical Instruments, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A stringed instrument, comprising:

a body comprising a top, a bottom, and sides, the sides connecting the top and the bottom to form a chamber, and the top having an opening with a perimeter;

a headstock comprising rollers adapted to receive strings;

a neck connecting the headstock to the body;

strings extending from the headstock, over the neck, and across a portion of the opening in the top of the body, the strings having tension;

a support ring having a diameter and a recess, the support ring located around the perimeter of the opening in the top of the body;

a cover plate covering at least a portion of said opening, the cover plate having a diameter less than that of the support ring such that a difference exists between the diameter of the support ring and the diameter of the cover plate;

a sealing conduit having a width greater than the difference between the support ring diameter and the cover plate diameter, the sealing conduit positioned proximate to the recess of the support ring to maintain a pressurized engagement between the support ring and the cover plate;

a resonant cone located within the chamber, the resonant cone adapted to move as a result of movement of the strings.

2. The instrument of claim 1 wherein the support ring comprises an inner reinforcement band and an outer reinforcement band.

3. The instrument of claim 1 wherein the support ring comprises circumferentially-aligned fibers to increase the strength of the support ring.

4. The instrument of claim 1 wherein the support ring comprises graphite.

5. The instrument of claim 1, further comprising a first sound opening in the top of the body and a second sound opening in the top of the body, and wherein the strings extend above a portion of the body that is between the first sound opening and the second sound opening.

6. The instrument of claim 1 wherein the cover plate further comprises a plurality of asymetrically-spaced openings and a solid platform providing a station for a user's hand.

7. The instrument of claim 1, wherein the top of the body substantially lies in a first plane and the bottom of the body substantially lies in a second plane, the first plane being substantially parallel to the second plane, and wherein the sides of the body lie substantially in a third plane substantially perpendicular to the second plane, and wherein the sides of the body are connected to the top of the body by a beveled portion forming a non-perpendicular angle with the sides of the body.

8. The instrument of claim 1, further comprising a resonator support ring mounted on the support ring and adapted to support the resonant cone.

9. The instrument of claim 1, wherein the support ring is configured to support the body without a spider or reinforcement bar.

10. The instrument of claim 1 wherein the cover plate comprises wood, and wherein the support ring is adapted to support the body without an additional internal reinforcement device.

11. The stringed instrument as recited in claim 8 wherein the support ring comprises graphite.

* * * * *